United States Patent [19]

Tashiro et al.

[11] 3,991,950

[45] Nov. 16, 1976

[54] METHOD AND APPARATUS FOR MAKING YARN PACKAGES OF CHEESE FORM BY A TEXTILE MACHINE

[75] Inventors: Ichiro Tashiro, Kariya; Kozo Motobayashi, Aichi; Kazuo Kamiya, Nishio; Toshio Yoshizawa, Chiryu; Yasuo Yamada, Kariya, all of Japan

[73] Assignees: Kabushiki Kaisha Toyoda Jidoshokki Seisakusho; Daiwa Boseki Kabushiki Kaisha, both of Osaka, Japan

[22] Filed: Feb. 5, 1974

[21] Appl. No.: 439,741

[30] Foreign Application Priority Data

July 17, 1973 Japan ..... 48-81101
Feb. 9, 1973 Japan ..... 48-16286

[52] U.S. Cl. ..... 242/18 DD
[51] Int. Cl.[2] ..... B65H 54/42
[58] Field of Search ..... 242/18 DD, 18 R, 65

[56] References Cited

UNITED STATES PATENTS

| | | | |
|---|---|---|---|
| 2,150,951 | 3/1939 | Toole et al. | 242/18 DD |
| 3,661,334 | 5/1972 | Graf | 242/18 DD |
| 3,672,583 | 6/1972 | Harrison | 242/18 R |
| 3,672,584 | 6/1972 | Macedo et al. | 242/18 R |
| 3,777,995 | 12/1973 | Funaloli et al. | 242/18 DD |

FOREIGN PATENTS OR APPLICATIONS

| | | | |
|---|---|---|---|
| 258,014 | 9/1926 | United Kingdom | 242/18 DD |
| 898,038 | 6/1962 | United Kingdom | 242/18 DD |

*Primary Examiner*—Stanley N. Gilreath
*Attorney, Agent, or Firm*—Burgess, Ryan and Wayne

[57] ABSTRACT

An improved method and apparatus for making yarn packages of cheese form by winding units of a textile machine, wherein a bobbin of a yarn package is rotatably supported by each cradle turnably supported by a pivot shaft secured to a bracket in such a condition that the contacting pressure between a yarn package and a friction roller for rotating the yarn package is gradually decreased in an exponential manner according to the increase in the size of the yarn package and the above-mentioned change of the contacting pressure is attained by utilizing means for compensating the contacting pressure which connects the cradle with the bracket.

5 Claims, 19 Drawing Figures

PRIOR ART

PRIOR ART

Fig. 14
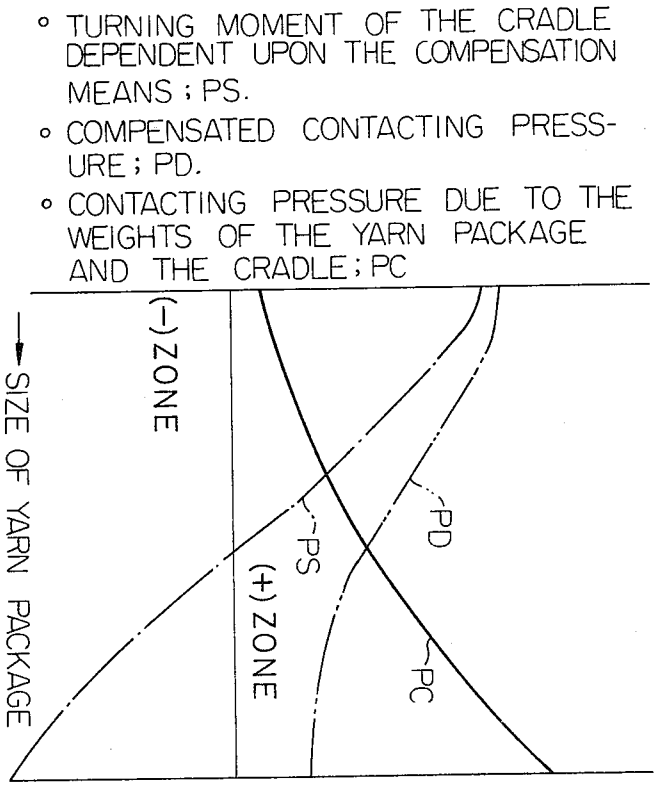
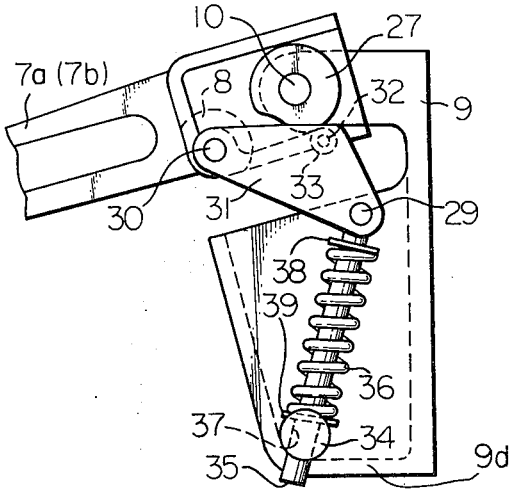
Fig. 15

METHOD AND APPARATUS FOR MAKING YARN PACKAGES OF CHEESE FORM BY A TEXTILE MACHINE

SUMMARY OF THE INVENTION

The present invention relates to an improved method and apparatus for making yarn packages of cheese form by a textile machine such as an open-end spinning apparatus, or a yarn winder.

Generally, in the conventional textile machines for making yarn packages of cheese form, each winding unit comprises a cradle turnably mounted on a supporting shaft which is secured to a bracket rigidly mounted on a frame of the machine, and a friction roller which is capable of contacting a bare bobbin when the winding operation is commenced or a yarn package formed on the bare bobbin during the winding operation, so that a bare bobbin or a yarn package is rotated by frictional contact with the friction roller. In the above-mentioned winding mechanism,, the contact pressure between the yarn package and the friction roller is increased according to the increase of diameter of the yarn package, because the contact pressure is defined mainly by the weight of the yarn package and the weight of the cradle. According to our experience, if the above-mentioned contact pressure increases improperly, both side surface of the cheese expand toward the outside and/or the peripheral surface of the cheese becomes bumpy so that the cheese cannot be used for mill operation without first applying a rewinding operation.

The principle object of the present invention is to provide an improved method and apparatus for making yarn packages of cheese form by applying proper contacting pressure between the yarn package and the friction roller of each winding unit of the textile machine so that the above-mentioned problem can be eliminated. To attain the purpose of the invention, the causal relation between the inadequate forming of cheese and the contacting pressure of a yarn package with the friction roller was first studied during repeated mill tests and, then, the following improved method and apparatus for making the yarn packages of cheese form by a textile machine were created. That is, in the present invention, the contacting pressure of the yarn package against the friction roller is controlled so that it decreases gradually according to the increase of the package diameter in such a condition that, in the main part of the predetermined compensation program, the rate of decreasing the contacting pressure is gradually decreased in exponential condition according to the increase of the package diameter. To satisfy the above-mentioned condition of the contacting pressure during the winding operation to make yarn packages of cheese form, in the apparatus of the present invention, means for compensating the contacting pressure between the yarn package and the friction roller during the winding operation is utilized, and a spring assembly or cam assembly is utilized as the above-mentioned compensation means.

The characteristic features and advantages of the present invention are hereinafter illustrated with reference to the embodiments shown in the attached drawings, however, any modifications in the spirit of the present invention are not restricted in the embodiments shown in these drawings.

BRIEF EXPLANATION OF THE DRAWINGS

FIG. 14 is a diagram showing the respective relationships between the size of the yarn package in the winding unit shown in FIG. 9 and the contacting pressure PC which is due to the weights of the yarn package (4) and the cradle (5), the turning moment of the cradle (5) which is dependent upon the compensation means PS and the compensated contacting pressure PD which is dependent upon the combination of PC and PS;

FIG. 15 is a side view of a part of a winding unit of the third embodiment according to the present invention;

DETAILED ILLUSTRATION OF THE INVENTION

Figure 1:
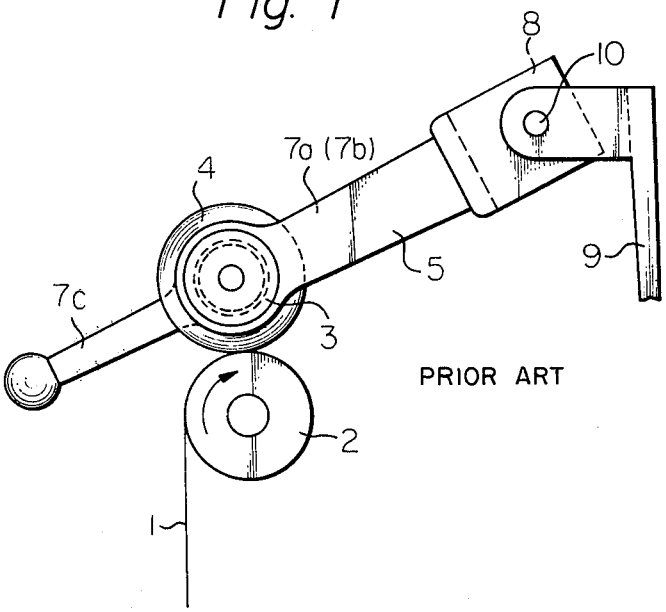
FIG. 1 is a side view of a main portion of a conventional winding unit for producing a yarn package on a bobbin.
Figure 2:
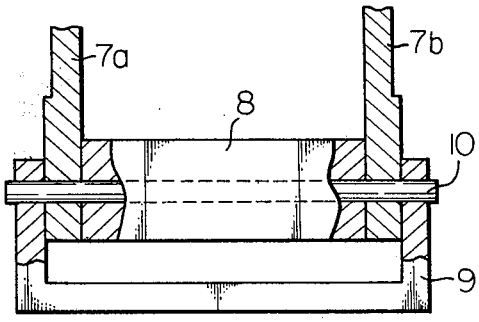
PRIOR ART Fig. 2
FIG. 2 is a plan view, partly in section, of a part of the winding unit shown in FIG. 1.
Figure 3:
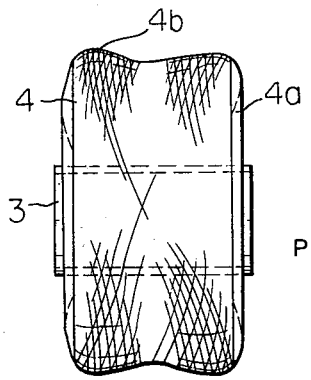
FIG. 3 is a front view of a defective yarn package having expanded sides and bumpy peripheral surface.
Figure 4:
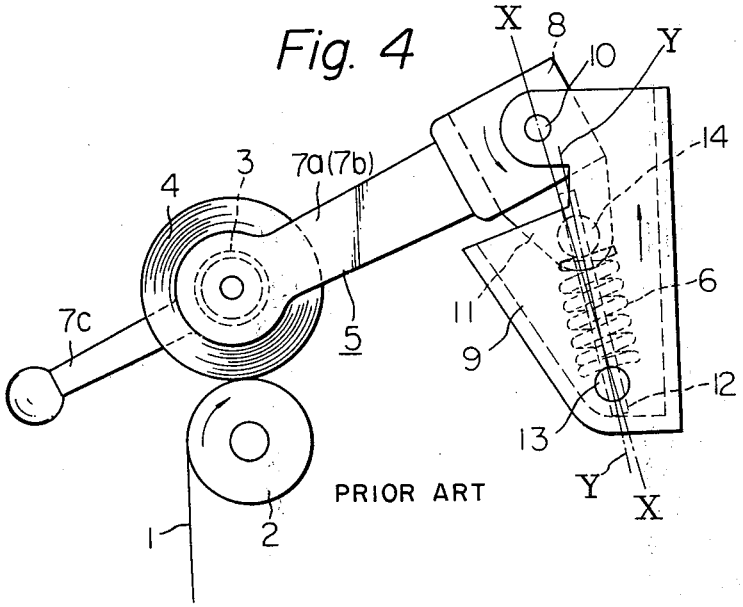
PRIOR ART Fig. 4
FIG. 4 is a side view of a main portion of another conventional winding unit for producing a yarn package on a bobbin.
Figure 5:
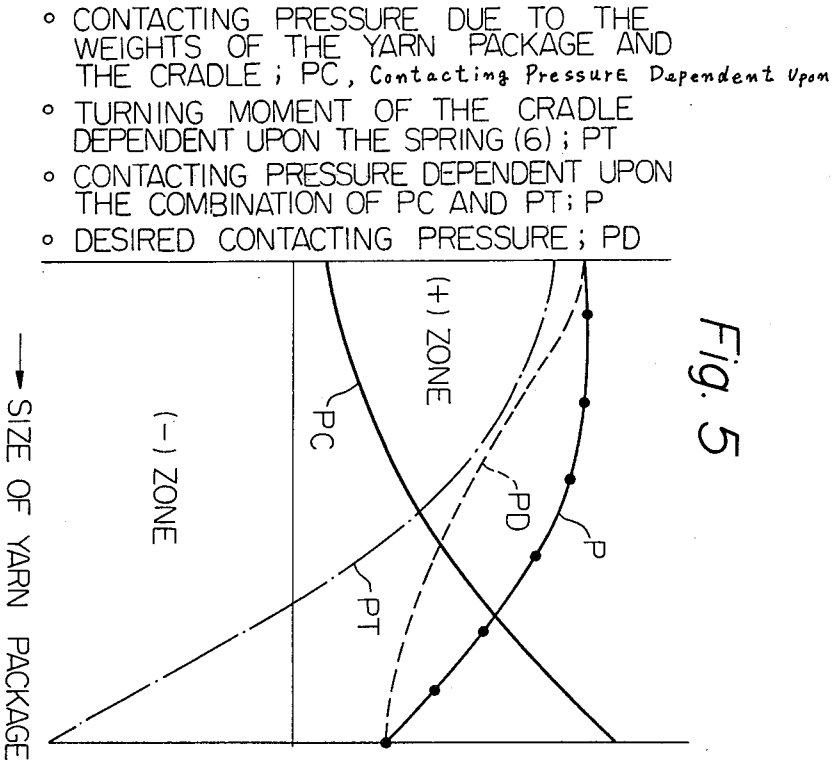
FIG. 5 is a diagram showing the respective relationships between the size of the yarn package in the winding unit shown in FIG. 6 and the contacting pressure PC which is mainly dependent upon the weights of a yarn package (4) and the cradle (5), the turning moment PT of the cradle (5) which is dependent upon the spring (6), the contacting pressure P which is dependent upon the combination of PC and PT, and the desired contacting pressure PD.

Before explaining the present invention , for the sake of a clearer understanding of the present invention, the drawbacks of the conventional apparatus for making yarn packages of cheese form by a textile machine is firstly illustrated. Referring to FIGS. 1 and 2, which show a conventional winding unit, a cradle 5 for turnably supporting a bobbin 3 is turnably mounted on a shaft 10 secured to a supporting bracket 9. The cradle 5 comprises a pair of arms 7a, 7b secured to a connecting member 8 in parallel condition, and the member 8 is turnably mounted on the shaft 10 together with the arms 7a, 7b. These arms 7a, 7b are provided with bobbin holding means (not shown) for turnably holding the bobbin 3 in such a condition that it is capable of contacting a friction roller 2 such as a split drum utilized for the conventional winder. One of the arms 7a, 7b is provided a handle 7c which is capable of operating the above-mentioned holding means so that it holds or releases a bobbin 3. Therefore, a yarn package 4 can be formed on the bobbin 3 by frictional contact with the friction roller 2 by way of which a yarn 1 is supplied. In the above-mentioed winding operation, the contact pressure between the yarn package 4 friction roller 2 is increased according to the increase in the diameter of the yarn package 4, because the contact pressure is defined mainly by the weight of the yarn package 4 and the weight of the cradle 5. It is our experience that yarn packages having improper shape, for example, yarn packages 4 having expanded side surfaces 4a and/or a bump peripheral surface 4b, as shown in FIG. 3, are often produced. If, such improper yarn packages are produced, it is necessary to rewind the yarn on a fresh bobbin so as to prevent any trouble in the successive process, such as a warping or cheese dyeing process. It has been understood that, to prevent the production of the above-mentioned improperly formed yarn package, the contacting pressure between the yarn package and the friction roller should be decreased according to he increase of the yarn package diameter, and also that the yarn tension during the winding opertion must be reduced together with the decrease of the contact pressure. To attain the above-mentioned condition, an improved cradle for supporting a yarn package, as shown in FIG. 4, has been introduced. That is, in FIG. 4, means for adjusting the contact pressure of the yarn package 4 against the friction roller 2 is utilized with the winding unit shown in FIG. 1. A portion 11 is projected downward from the connecting member 8. A horizontal rod 14 provided with an aperture is secured to the projected portion 11. A rod 13 provided with an aperture is secured to the supporting bracket 9 and a guide rod 12 is held by the rods 13 and 14 in such a way that a bottom end of the rod 12 is rigidly inserted into the aperture of the rod 13 while an upper end portion of the rod 12 is slidably inserted into the aperture of the rod 14. A helical spring 6 is mounted on the rod 12 between the rods 13 and 14 in compressed condition. At the time of starting the winding operation, the axial line of the rod 14 is positioned on an opposite side to the friction roller 2 with respect to a plane through the axial line of the shaft 10 and the axial line of the rod 13. (The above-mentioed plane is represented by a line X—X in FIG. 4.) And the axial line of the rod 14 is displaced toward the side of the friction roller 2 with respect to the line X—X according to the increase of the yarn package diameter, that is, according to the upward turning motion of the cradlle 5. Consequently, the turning force PT imparted to the cradle 5 which is only created by the spring 6 varies as shown in FIG. 5 when the diameter of the yarn package is increased. On the other hand the contact pressure PC of the yarn package 4 depends upon the cradle weight and the increased weight of the yarn package when, as shown in FIG. 5, the diameter of the yarn package is increased.

The above-mentioned two forces are combined as the actual contacting force P between the yarn package 4 and the friction roller 2 and the actual contacting force changes as shown in FIG. 5. It may be understood that the variation curve of the actual contacting force P can be changed by changing the characteristic feature of the spring 6. However, during repeated mill tests, it was found that, as long as the shape of the variation curve of the actual contacting force P belongs to the type of variation curve shown in FIG. 5, in other words, the contacting force is continuously lowered during the winding operation and the rate of decreasing the contacting pressure is initially very small and gradually increases according to the increase of the diameter of the yarn package, the production of yarn packages having inadequate shape, as shown in FIG. 3, cannot be prevented. Based on the above-mentioned result, it was interpreted that, the contacting pressure between the yarn package and the friction roller at an initial period of the winding operation should be sufficiently large to prevent slip therebetween so as to form a core portion of the yarn package. However, if the contacting pressure is excessively large when the middle yarn layers of the package are formed, the middle yarn layers tend to expand outside and, consequently, it is better to rapidly decrease the contacting pressure when the middle layer portion of the full package is being formed and, after that, it is better to decrease the contacting force gradually until the yarn package of full size is produced. This type of variation curve of the contacting pressure is PD in FIG. 5.

Figure 6:
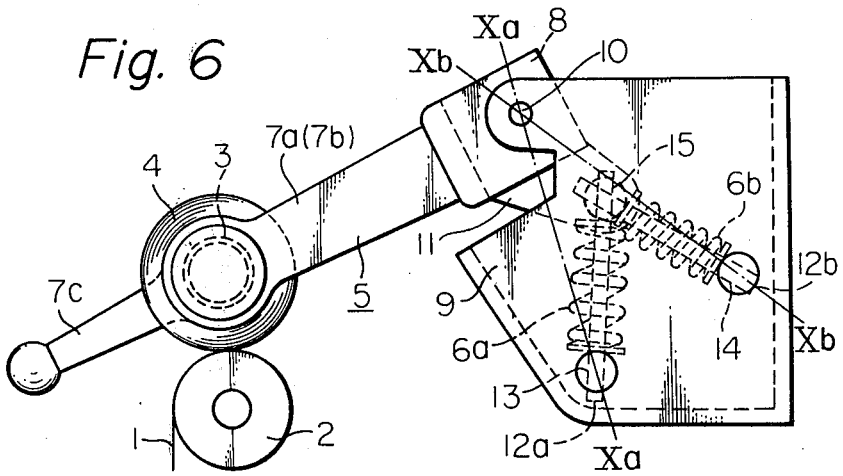
FIG. 6 is a side view of a main portion of a winding unit of the first embodiment according to the present invention.
Figure 7:
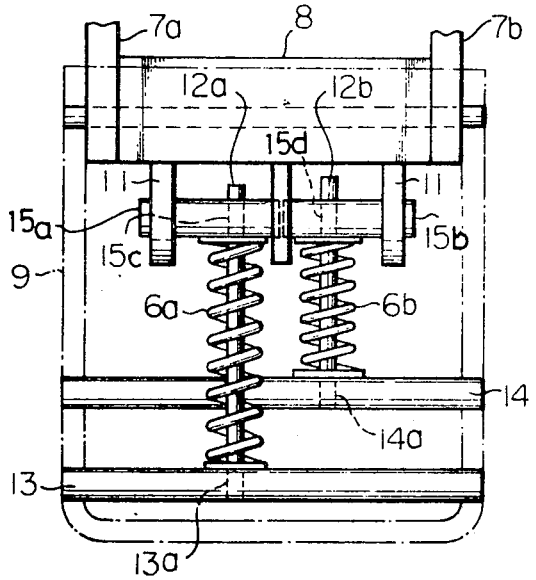
FIG. 7 is a plan view of a part of the windng unit shown in FIG. 6.
Figure 8:
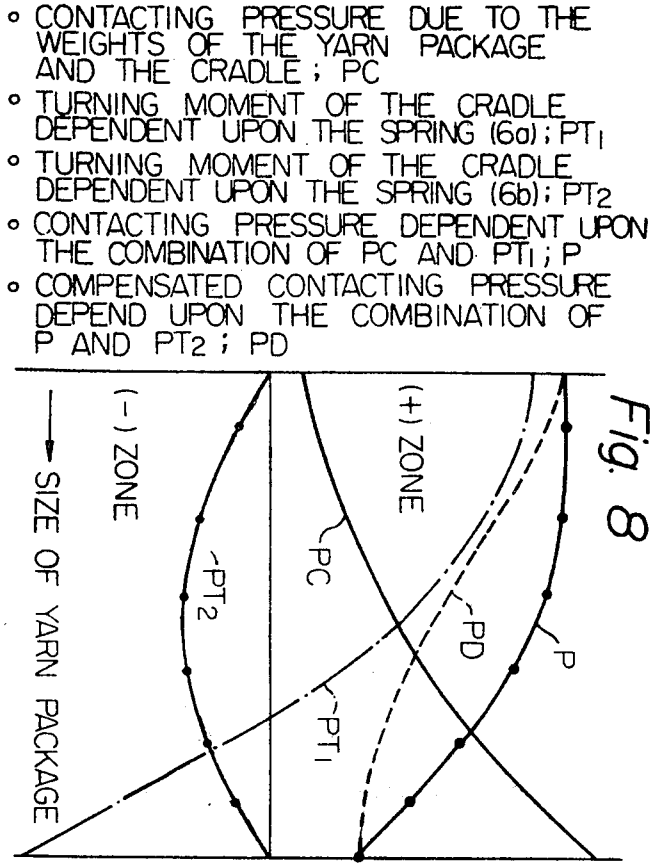
FIG. 8 is a diagram showing the respective relationships between the size of the yarn package in the winding unit shown in FIG. 6 and the contacting pressure PC which is due to the weights of the yarn package (4) and the cradle (5), the turning moment $PT_1$ of the cradle (5) which is dependent upon the spring (6*a*), the turning moment $PT_2$ of the cradle (5) which is dependent upon the spring (6*b*), the contacting pressure P which is dependent upon the combination of PC and $PT_1$, and the compensated contacting pressure PD which is dependent upon the combination of P and $PT_2$.

In the present invention, to create the above-mentioned compensation of the contacting pressure, represented by a shape of the curve PD in FIG. 5, a pair of helical springs are utilized as a first embodiment, wherein the equivalent elements to the device shown in FIG. 1 are designated by the same reference numerals as the drawing of FIG. 1. In the first embodiment shown in FIGS. 6 and 7, the connecting member 8 is turnably mounted on the pivot shaft 10 secured to the bracket 9 and a pair of projections 11 and an intermediate projections are projected from the member 8. A pair of horizontal shafts 15a, 15b are turnably held by the projections 11 and 11a as shown in FIG. 7 in such a way that shafts 15a, 15b are independently turned. A pair of horizontal rods 13, 14 are turnably secured to the supporting bracket 9. The rods 15a and 15b are provided with a pair of apertures 15c, 15d, respectivelly while the rods 13, 14 are provided with apertures 13a, 14a, respectively, at positions facing the apertures 15c, 15d, respectively. A rod 12a is rigidly inserted into the aperture 13a of the rod 13, while another rod 12b is rigidly inserted into the aperture 14a of the rod 14, and the other end portions of these rods 12a, 12b are slidably inserted into the apertures 15c, 15d of the respective horizontal rods 15a, 15b. A helical spring 6a is mounted on the rod 12a in compressed condition at a position between the rods 15a and 13, while another helical spring 6b is mounted on the rod 12b in compressed condition at a position between the rods 15b and 14. The relative arrangements of the rods 13, 14 together with he rods 12a, 12b, helical springs 6a, 6b are so designed that the diposition of the rod 13 and the helical spring 6a contributes to define the adjustment of the contacting pressure between the yarn package 4 and the friction roller 2 by the curve PT in FIG. 5, while the disposition of the rod 14 and the helical spring 6b contributes to compensate the contacting pressure P by a curve $PT_2$ in FIG. 8. That is, the turning moment of the cradle 5 created by the force of the spring 6*a* varies according to the curve $PT_1$, in FIG. 8 when the diameter of the yarn package is increased, while the turning moment of the cradle 5 created by the force of the spring 6*b* varies according to the curve $PT_2$ in FIG. 8 when the diameter of the yarn package is increased. To attain the above-mentioned results, the working line of the spring 6*a* to a plane passing through axial lines of the rods 15*a*, 13 (represented by a line X*a*—X*a* in FIG. 6) is displaced according to the size of the yarn package 4 in a manner similar to the device shown in FIG. 4, while the working line of the rods 15*b* and 14 (represented by a line X*b*—X*b* in FIG. 6) is displaced in such a way that the force of the spring 6*b* always creates a negative turning moment of the cradle 5. Consequently, when the contacting pressure PC created only by the weight of the yarn package 2 together with the weight of cradle 5 is combined with the turning moment of the cradle 5 about the shaft 8 which is created by the spring 6*a*, the combined pressure between the yarn package 2 and the friction roller 2 is changed as indicated by the curve P in FIG. 8 which is similar to the curve P in FIG. 5. However, in this embodiment, the negative turning torque of the cradle 5 about the shaft 8, which is created by the spring 6*b*, is added to the above-mentioned contacting pressure P, so that the actual contacting pressure is forced to change to the curve PD wherein the contacting force is continuously lowered during the winding operation and the rate of decreasing the contacting pressure is initially very small and is comparatively large during the forming of the middle layers of the yarn package, and then the rate of decreasing the contacting pressure is gradually lowered until the yarn package of full size is produced. In the above-mentioned embodiment, the distance between the rod 13 and the rod 15 is longer than that of between the rod 14 and the rod 15, and consequently, the above-mentioned relative arrangements of the helical springs 6*a*, 6*b* can be easily designed so as to create the combination effect upon the adjustment for the contacting pressure between the yarn package 4 and the friction roller 4. In the first embodiment, the characteristic features of these springs 6*a*, 6*b* can be modified so that the contacting pressure is maintained constant at the period of commencing the winding operation, and then the contacting pressure is changed to the above-mentioned desirable condition.

Figure 9:
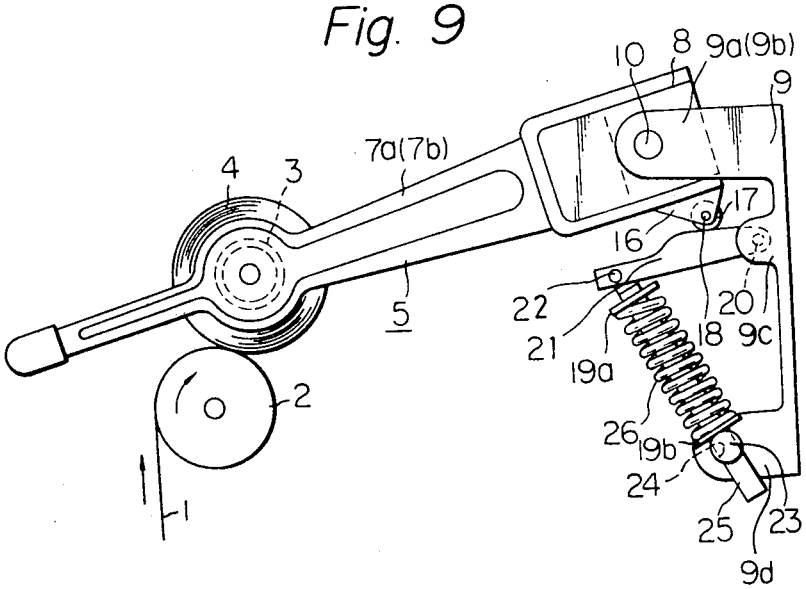
FIG. 9 is a side view of a main portion of a winding unit of the second embodiment according to the present invention.
Figure 10:
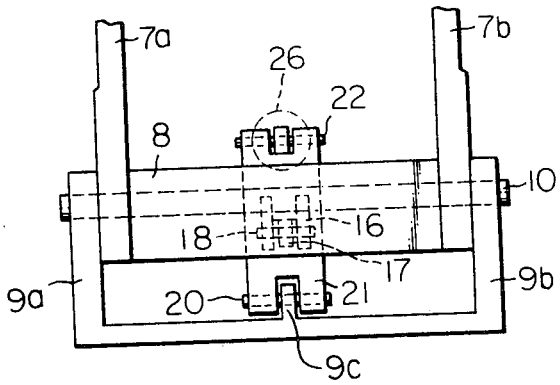
FIG. 10 is a plan view of a part of the winding unit shown in FIG. 9.

In the second embodiment of the present invention, which is shown in FIGS. 9 and 10, elements similar to the first embodiment are designated by identical reference numerals as used for the first embodiment, and the functions thereof are omitted from the following explantion. The arms 7*a*, 7*b* of the cradle 5 are rigidly secured to the connecting member 8 and they are turnably mounted on the shaft 10 which is secured to a pair of horizontal supporting arms 9*a*, 9*b* of the bracket 9. The connecting member 8 is provided with a bracket 16 projected downward and a roller 17 is turnably mounted on a shaft 18 secured to the bracket 16. The bracket 9 is provided with a projection 9*c* formed at a lower level than the roller 17, and a cam plate 21 is turnably mounted on a pivot shaft 20 secured to the projection 9*c* of the bracket 9 in such a condition that the roller 17 is always capable of contacting the cam surface of the cam plate 21. Therefore the roller 17 works as a cam follower to the cam plate 21. The bracket 9 is provided with another projection 9*d* formed at a bottom end thereof. A horizontal rod 23 is rigidly mounted on the projection 9*d*. A rod 25 is slidably inserted into an aperture 24 of the horizontal rod 23 and a top end portion thereof is turnably held by a pin 22 secured to a free end portion of the cam plate 21. Washers 19*a*, 19*b* are mounted on the rod 25. A helical spring 26 is mounted on the rod 25 at a position between these cam plate 21 and the rod 23 by way of these washers 19*a*, 19*b* in compressed condition.

Consequently, the spring force of the helical spring 26 works to the cradle 5 by way of the cam plate 21 and roller 17. To adjust the contacting pressure between the yarn package 4 and the friction roller 2 to the desirable condition discussed in the explanation of the firt embodiment shown in FIG. 6, the relative dispositions of these elements, the small roller 17, the cam plate 21 and the helical spring 26 must be carefully decided. That is, these elements are arranged so as to satisfy a particular condition which is hereinafter explained with reference to FIGS. 11, 12 and 13.

Figure 11:
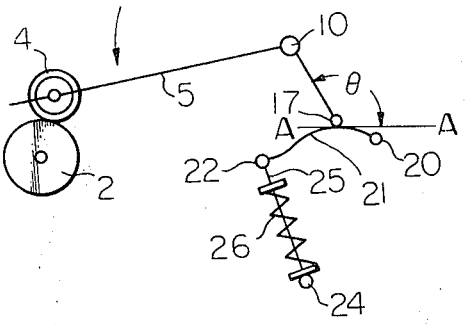
FIGS. 11, 12 and 13 are schematic side views of the winding unit shown in FIG. 9, at three different situations during the winding operation.

When the winding operation is started, the contacting pressure between the yarn package 4 and the friction roller 2 is insufficient to wind the yarn 1 on the bobbin 3 in a compact condition, if the above-mentioned contacting pressure is only dependent upon the weights of the cradle 5 and the yarn package 4. To compensate the above-mentioned condition of insufficient contacting pressure, an additional force created by the spring 26 is applied to the cradle 5 as shown in FIG. 11. In the following analysis, for the sake of simplification of the illustration, the dynamic relation between elements is explained in a two-dimensional manner, and the shaft 10, small roller 17, pivot shaft 20 and pin 22 are considered as points, respectively.

In the condition shown in FIG. 11, an angle $\theta$ between a line passing the shaft 10 and the small roller 17, and a tangential line to the cam surface of the cam plate 21 at the point 17, at the side of the pivot shaft 20, is larger than 90°. The expansion force of the spring 26 which works to the pin 22 creates a force for turning the cam plate 21 clockwise about the pivot shaft 20. Consequently, the turning force of the cam plate 21 about the pivot shaft 20 creates an upward force for pushing the roller 17 upward. As the above-mentioned angle $\theta$ is an obtuse angle, the above-mentioned upward force works to push the cradle 5 toward the friction roller 2, in other words, an additional pushing force is applied to the yarn package 4 so that the contacting pressure between the yarn package 4 and the friction roller is supplemented. The size of the yarn package 4 is gradually increased during the winding operation, and when the size of the yarn package reaches a condition shown in FIG. 12, that is where the above-mentioned angle $\theta$ becomes 90°, the expansion force of the spring 26 cannot work to the cradle 5 at all. This is because a component force directed to the line passing through the shaft 10 and the roller 17 which depends upon the turning force of the cam plate 21 about the pivot shaft 20, has no effect on the cradle 5. In other words, in this condition, the contacting pressure only depends upon the weights of the yarn package 4 and the cradle 5.

Figure 13:
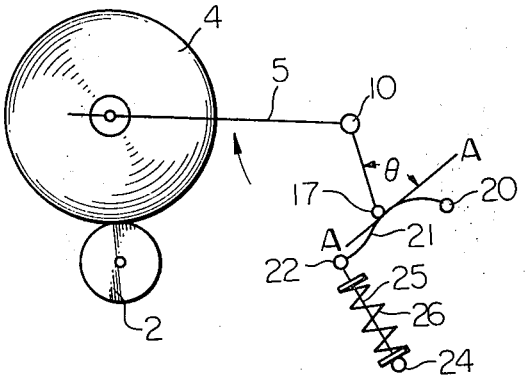

As the size of the yarn package 4 is further increased, the above-mentioned angle $\theta$ becomes smaller than 90° and continues to decrease and the expansion force of the spring 26 works to displace the cradle 5 toward the opposite direction from the friction roller 2 as shown in FIG. 13. If the cam profile of the cam plate 21 is adequately designed, the above-mentioned turning force imparted to the cradle 5 can be gradually increased according to the increase of the size of the yarn package 4. In other words, the contacting pressure between the yarn package 4 and the friction roller is decreased by the above-mentioned action of commpensation. Therefore, if the relative disposition of the small roller 17, cam plate 21, pivot shaft 20, pin 22, rod 24 and rod 25, and the characteristic feature of the spring 26 and shape of the cam profile of the cam 21, are designed so as to create the relative conditions shown in FIG. 14 between curves the turning moment PS of the cradle 5 dependent upon the compensation means and the contacting pressure PC due to the weights of the yarn package 4 and the cradle 5, the desired condition represented by the curve of the compensated contacting pressure PD between the yarn package 4 and the friction roller 2 can be attained.

Figure 16:
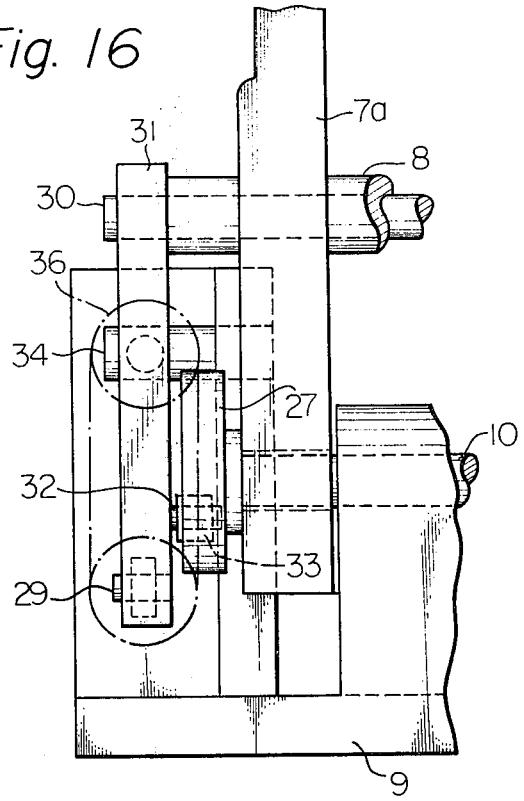
FIG. 16 is a plan view of a part of the winding unit shown in FIG. 15.

In the third embodiment shown in FIGS. 15 and 16, instead of utilizing the combination of the cam plate 21 and the roller 17, a circular cam mechanism is utilized for the compensation means. In this particular example a pair of compensation means is adopted to each side of the cradle 5. Therefore, only one side of the compensation means which is situated at the side of the arm 7*a* is hereinafter explained.

Figure 12:
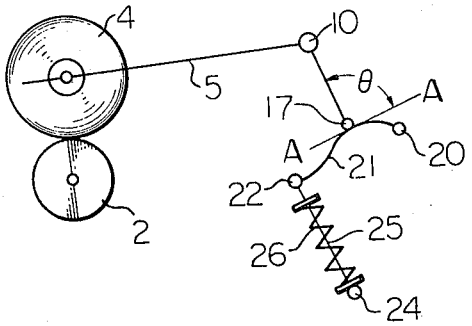

Referring to FIGS. 15 and 16, in the third embodiment of the present invention, a circular cam 27 is rigidly mounted on the shaft 10. A swing bracket 31 is turnably mounted on a pivot shaft 30 secured to the connecting member 8 of the cradle 5, and the swing bracket 31 is provided with a follower roller 33 which is turnably mounted on a shaft secured to the bracket 31 in such a condition that the roller 33 is always capable of contacting the circular cam 27. The bracket 31 has an aproximately triangular shape. The bracket 9 is provided with a projected portion 9*d* and a rod 34 is turnably mounted to the projected portion 9*d* as shown in FIG. 15. The rod 34 is provided with an aperture 37. A rod 35 is slidably inserted into the aperture 37 of the rod 34 and a top portion of the rod 35 is turnably mounted on a pin 29 which is secured to a corner portion of the swing bracket 31, and a pair of washers 38, 39 are mounted on the rod 35. In the above-mentioned assembly of the compensation means, a helical spring 36 is mounted on the rod 35 at a position between the swing bracket 31 and the rod 34 by way of the washers 38, 39, in compressed condition. Consequently, if the cam profile of the circular cam 27 is adequately designed as hereinafter illustrated in detail with reference to he drawings of FIGS. 17, 18 and 19, the contacting pressure between the yarn package 4 and the friction roller 2 can be adjusted so as to correspond to the curve PD in FIG. 14 according to the increase of the package size. In the following illustration, for the sake of simplified explanation, the two dimensional assumption similar to the explanation about the operation of the compensation means in FIGS. 11, 12 and 13, is applied.

Figure 17:
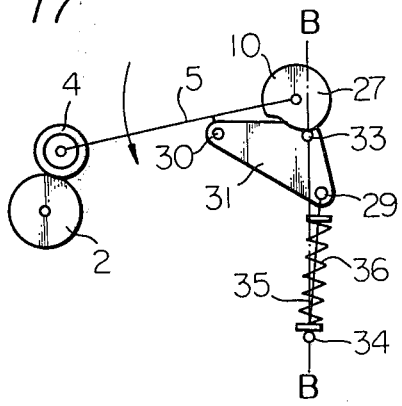
FIGS. 17, 18 and 19 are schematic side views of the winding unit shown in FIG. 15, at three different situations during the winding operation.
Figure 18:
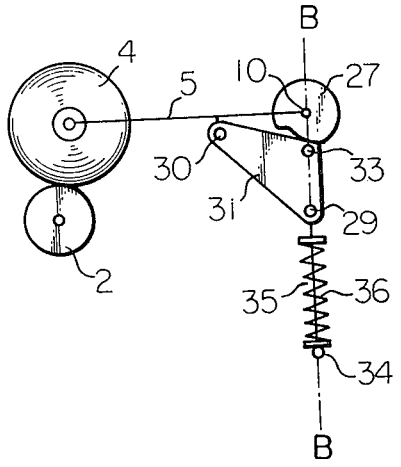
Figure 19:
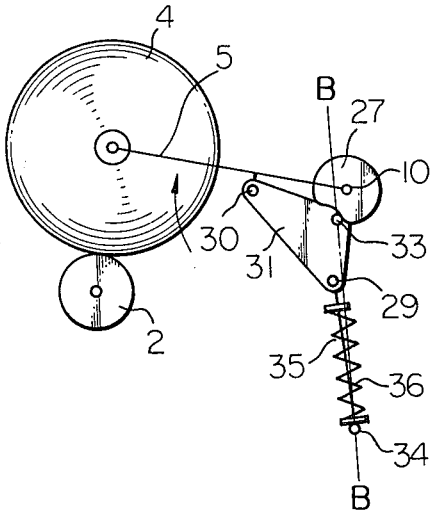

Referring to FIGS. 17, 18 and 19, at the initial condition when the winding operation is commenced, the expansion force of the spring 36 works at the opposite side from the friction roller 2 of the line B—B passing through the rod 34 and the roller 33. Consequently, the pin 29 exerts the turning force pin 30 in the direction of counterclockwise so as to turn the cradle 5 counterclockwise in FIG. 17, in other words, an additional force to increase the contacting pressure between the yarn package 4 and the friction roller 2 is created. When he size of the yarn package 4 is increased and reaches the condition shown in FIG. 18, the expansion force of the spring 36 works along the the line B—B, so that the spring 36 does not work to turn the cradle 5, in other words, the contacting pressure between the yarn package 4 and the friction roller 2 only depends upon the weights of the yarn package 4 and the cradle 5. When the size of the yarn package 4 is further increased wherein the expansion force of the spring 36 works to the swing the pin 29 of the bracket 31 beyond the line B—B on the side of the friction roller 2, that is, the relative disposition of the elements of the compensation means reaches a condition shown in FIG. 19, as the component force of the above-mentioned expansion force of the spring 36 creates a turning moment of the cradle 5 about the pin 30 in the clockwise direction in FIG. 19, the cradle 5 receives a clockwise turning moment about the shaft 10 by pin 30. Consequently, the amount contacting pressure between the yarn package 4 and the friction roller 2 dependent upon the weights of the yarn package 4 and the cradle 5 is reduced by the above-mentioned turning moment of the cradle 5. Therefore, as in the second embodiment shown in FIG. 9, if the cam profile of the circular cam 27, relative arrangements of the roller 33, pivot shaft 30, pin 29 and the rod 34, and the characteristic feature of the spring 36 are adequately selected, the desirable condition for adjusting the contacting pressure between the yarn package 4 and the friction roller 2 can be satisfactorily attained.

In the above-mentioned, the contacting pressure between the yarn package 4 and the friction roller 2 is gradually decreased from the starting of the winding operation. However, if a yarn of thicker count is handled, it is preferably to maintain the initial condition of the contacting pressure until a core portion of the yarn package is formed. In this regard it has been confirmed that, if the relative position of the elements in the compensation means and the characteristic feature of the spring are adequately selected, such maintenance of the initial condition can be easily created.

As mentioned above, by utilizing the apparatus for making yarn packages of cheese form according to the present invention, troubles due to the creation of outside expansion and/or bumpy peripheral surface of the cheese can be completely eliminated and, consequently, the size of the yarn package can be remarkably increased in mill operations.

What is claimed is:

1. In an apparatus for winding cylindrical yarn packages on a bobbin with a winding unit of a textile machine wherein each said unit comprises a friction roller, means for urging a yarn package into frictional contact with said friction roller to rotate said yarn package during a winding operation and means for adjusting the contact pressure between said yarn package and said friction roller during the winding operation, the improvement wherein said means for urging said yarn package into contact with said friction roller comprises support means, arm means pivotally mounted on said support means, and holding means on said arm means for rotatably supporting said yarn package in contact with said friction roller to produce an increasing component of said contact pressure as the size of the yarn package increases and wherein said adjusting means comprises projection means on said arm means, and first and second compression spring means positioned between said support means and said projection means to exert a rotational force on said arm means, said first spring means being mounted to provide a turning moment on said arm means that initially acts in the same direction as the weight of said yarn package, and acts in a direction opposite of the weight of the yarn package as the size of said yarn package increases, said second spring means being mounted to continually provide a turning moment on said arm means that opposes the weight of said yarn package as the size of said yarn package increases, whereby said contact pressure of said friction roller exponentially decreases said contact pressure as the size of said yarn package increases, and whereby the rate of decrease of said contact pressure is gradually reduced as the size of the yarn package increases.

2. In an apparatus for winding cylindrical yarn packages on a bobbin with a winding unit of a textile machine wherein each said unit comprises a friction roller, means for urging a yarn package into frictional contact with said friction roller to rotate said yarn package during a winding operation, and means for adjusting the contact pressure between said yarn package and said friction roller during the winding operation, the improvement wherein said means for urging said yarn package into contact with said friction roller comprises support means, arm means pivotally mounted on said support means, and holding means on said arm means for rotatably supporting said yarn package in contact with said friction roller to produce an increasing component of said contact pressure as the size of the yarn package increases, and wherein said adjusting means comprises first and second rod means mounted on said arm means and having axes parallel to the rotational axis of said arm means, third and fourth rod means mounted on said support means and having axes parallel to the axes of said first and second rod means, first compression spring means between said first and third rod means, and second compression spring means between said second and fourth rod means, whereby said compression spring means exert turning moments on said arm means, said first and third rod means being positioned to exert a turning moment on said arm means due to said first compression spring means in the same direction as the weight of said yarn package initially during the winding of said yarn package, and that opposes the turning moment of said arm means due to the weight of said yarn package as the size of said yarn package increases, said second and fourth rod means being positioned wherein the turning moment of said arm means due to said compression spring means is always in opposition to the turning moment due to the weight of said yarn package, whereby the component of contact pressure due to the weight of said yarn package is compensated.

3. The apparatus of claim 2, wherein the distance between said first and third rods is greater than that between said second and fourth rods, said first and second rods being coaxial, and the axes of said first and second rods being displaced from a plane defined by said third axis and the pivotal axis of said arm means at the start of winding of said yarn package.

4. The apparatus of claim 2, wherein the combined turning moment on said arm means resulting from the weight of said yarn package and said first and second compression springs is substantially constant at the initiation of the winding of said yarn package.

5. In an apparatus for winding cylindrical yarn packages on a bobbin with a winding unit of a textile machine wherein each said unit comprises a friction roller, means for urging a yarn package into frictional contact with said frictional roller to rotate said yarn package during a winding operation, and means for adjusting the contact pressure between said yarn package and said friction roller during the winding operation, the improvement wherein said means for urging said yarn package into contact with said friction roller comprises means for holding said yarn package so that the increasing weight of the yarn package produces an increasing component of said contact pressure as the size of the yarn package increases, said adjusting means comprising means for exponentially decreasing said contact pressure as the size of the yarn package increases thereby gradually reducing the rate of decrease of said contact pressure as the size of the yarn package increases throughout the winding operation, and including a cam means mounted to said arm means at the pivotal axis thereof, compression spring means, means pivotally mounting one end of said compression spring means to said support means, swinging bracket means pivotally mounted between said arm means and the other end of said spring means, and roller means on said swinging bracket means positioned to engage said cam means, whereby said spring means exerts a turning moment on said arm means in dependence on the position of contact between said roller means and said cam means for compensating the component of contact due to the weight of said yarn package.

* * * * *